United States Patent [19]

Vorsanger et al.

[11] 4,223,820

[45] Sep. 23, 1980

[54] HOLDER FOR TRIANGULAR CARPENTER'S SQUARE

[76] Inventors: Guy E. Vorsanger, 15 Elder La., La Grange, Ill. 60525; Michael J. Nickel, 107 McCameron Ave., Lockport, Ill. 60441

[21] Appl. No.: 921,833

[22] Filed: Jul. 3, 1978

[51] Int. Cl.[2] ..... A45C 1/04; A45C 11/36

[52] U.S. Cl. ..... 224/253; 224/904; 224/223

[58] Field of Search ..... 224/5 A, 5 R, 26 R, 224/5 C, 2 B, 2 D, 2 F, 26 C, 45 K; 206/224, 214, 371, 305; 24/3 R; 33/92, 474, 479, 480

[56] References Cited

U.S. PATENT DOCUMENTS

| | | | |
|---|---|---|---|
| Re. 12,112 | 5/1903 | Trescott | 206/214 |
| 1,320,751 | 11/1919 | Freyer | 224/2 B |
| 1,413,290 | 4/1922 | O'Leary | 224/2 B |
| 1,675,072 | 6/1928 | Watermon | 224/5 A |
| 2,105,290 | 1/1938 | Maher | 2/1 |
| 2,243,260 | 5/1941 | Rindos | 206/579 |
| 2,951,622 | 9/1960 | Heim | 224/2 B |
| 3,130,883 | 4/1964 | MacKool | 5 A/ |
| 3,172,583 | 3/1965 | Smith | 224/5 A |
| 4,047,650 | 9/1977 | Domingos | 224/5 A |
| 4,055,283 | 10/1977 | Habler | 224/5 R |

*Primary Examiner*—Kenneth W. Noland
*Attorney, Agent, or Firm*—Vogel, Dithmar, Stotland, Stratman & Levy

[57] ABSTRACT

A pouch-like holder for a triangular carpenter's square includes a single sheet of flexible material which is folded in half to form two congruent panels, each in the shape of a truncated triangle, with the side edges opposite the fold line being secured together along a closure line disposed at about a 45° angle to the fold line to define a triangular pocket having a large open top and a small open bottom for receiving the square therein. Belt slits are provided in each of the panels and a retainer strap is also provided across the top edges of the panels. The holder also has alternative closures and belt attachment devices.

8 Claims, 9 Drawing Figures

HOLDER FOR TRIANGULAR CARPENTER'S SQUARE

BACKGROUND OF THE INVENTION

The present invention relates to holders for carpenter's squares and, in particular, to a holder for a triangular-shaped carpenter's square.

Normally, carpenters on the job wear specially designed tool aprons or tool belts for convenient carrying of their hand tools such as hammers, nails, measuring tape, carpenter's square and the like. Such belts have special loops or pockets for each of these standard tools, and aprons may be provided with large pockets in which nails and miscellaneous tools may be carried.

Heretofore, carpenters have typically used a carpenter's square of the conventional L-shaped design having one long leg and one short leg. These squares could conveniently be carried in a suitably dimensioned loop in a tool belt or apron or could, alternatively, simply be carried in the carpenter's trousers belt by inserting the long end of the square beneath the belt.

Recently, however, this conventional L-shaped carpenter's square is rapidly being supplanted by a triangular-shaped carpenter's square which is more convenient to use than the L-shaped square. However, there is no place on a carpenter's tool belt or apron which will conveniently accommodate this triangular-shaped square. Accordingly, carpenters using such triangular squares have to place them in a large apron pocket or try to insert them in the waistband of their trousers or under their belts and, in such cases, the triangular square frequently falls out, resulting in considerable inconvenience to the carpenter and possible loss of the square. Since the cost of the square is not insignificant and carpenters normally own their own tools, the risk of loss or misplacement of the square constitutes a considerable disadvantage. Also, when the square is placed under the waistband of the carpenter's trousers, it tends to tear his shirt and it must be removed whenever the carpenter sits down.

Aprons or pouches for the tools of artisans or craftsmen are disclosed, for example, in U.S. Pat. Nos. Re. 12,112 and 1,675,072, but such carriers do not provide holders for flat triangular-shaped articles such as the triangular carpenter's square. Also, individual holsters for irregular-shaped objects are disclosed, for example, in U.S. Pat. Nos. 1,413,290, 2,951,622 and 4,055,283, these being respectively designed for holding handcuffs, a pistol and a smoking pipe. But no such holster type of holder is suitable for a flat triangular-shaped carpenter's square.

SUMMARY OF THE INVENTION

The present invention relates to an improved holder for carrying a carpenter's square.

More particularly, it is an important feature of the present invention that the holder is uniquely designed for conveniently carrying a triangular-shaped carpenter's square.

Another feature of the invention is that the holder is mountable on the belt of a user on either his right or left side, and is of simple and economical construction, while providing a secure carrying pocket for the carpenter's square.

Still another feature of the invention is that means are provided for securely fastening the associated carpenter's square in the holder.

In summary, these features are attained by providing a belt-mountable holder for a triangular carpenter's square comprising a flexible sheet of unitary single-piece construction arranged in a single-folded configuration, the sheet including a front panel and a rear panel disposed substantially congruent with each other and a fold portion interconnecting the front and rear panels along a fold line, each of the front and rear panels having a straight top edge and a straight side edge with the top edges being substantially parallel with each other and interconnected by the fold portion and the side edges being substantially parallel with each other and disposed opposite the fold portion, means securing together the side edges of the front and rear panels along a straight closure line disposed at a predetermined acute angle to the fold line for cooperation with the fold portion and with the front and rear panels to define a substantially triangular pocket dimensioned to accommodate an associated triangular carpenter's square, and means for removably attaching the holder to the belt of a user.

Further features of the invention pertain to the particular arrangement of the parts of the carpenter's square holder whereby the above-outlined and additional operating features thereof are attained.

The invention, both as to its organization and method of operation, together with further objects and advantages thereof, will best be understood by reference to the following specification taken in connection with the accompanying drawings.

DESCRIPTION OF THE PREFERRED EMBODIMENTS

Figure 1:
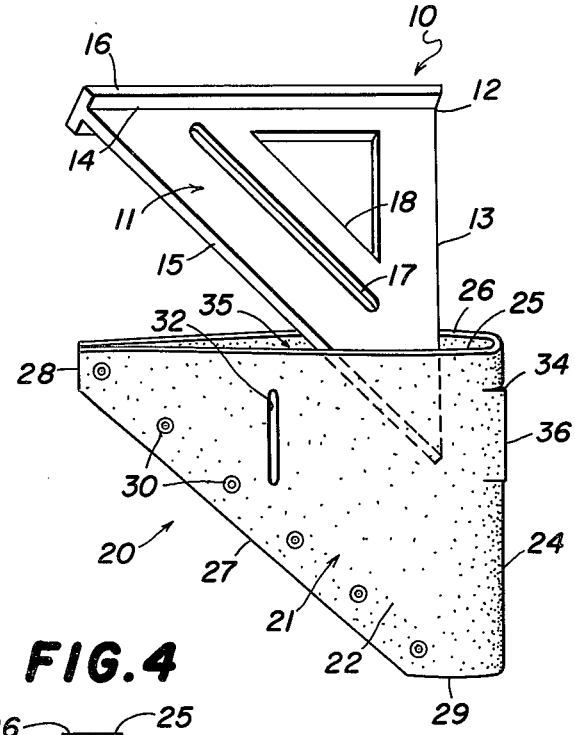
FIG. 1 is a front perspective view of the holder of the present invention, with a carpenter's square shown partially inserted therein.

Referring now to FIGS. 1 through 5 of the drawings, there is illustrated a holder for a triangular carpenter's square, generally designated by the numeral 10, the holder being constructed in accordance with and embodying the features of the present invention, and generally designated by the numeral 20. The triangular carpenter's square 10 comprises a flat triangular metal plate 11, which is preferably formed of a strong aluminum alloy, and is in the shape of a 90°-45°-45° triangle. The plate 11 includes a right-angle corner 12 at the intersection of a pair of equal-length perpendicular edges 13 and 14, the opposite ends of which are interconnected by an elongated edge 15, which forms the hypothenuse of the triangle. Integral with the edge 14 and extending laterally outwardly therefrom on both sides of the plate 11 is a flat rectangular flange 16 to assist in positioning the square 10 against an edge of an associated workpiece. Preferably, the plate 11 has an elongated slot 17 and a triangular lightening aperture 18 therethrough.

Typically, the square 10 is provided on both sides of the plate 11 with various scales and indicia (not shown) to facilitate making a plurality of angle and distance measurements. The triangular square 10 may be of the type manufactured by the Swanson Tool Co. and sold under the trade name "Swanson Speed Square", the elongated edge 15 being approximately ten inches in length, and the shorter edges 13 and 14 being approximately seven inches in length.

The holder 20 is preferably formed of a one-piece sheet 21 of flexible material, which is initially generally trapezoidal in shape, and which is folded in half to form substantially congruent front and rear panels 22 and 23 interconnected by a fold portion 24. The designations of the panels 22 and 23 as being "front" and "rear" is arbitrary, and these designations correspond respectively to the outer and inner panels of the holder 20 when it is worn on the user's right-hand side. As will be apparent from the following description, however, the holder 20 can be worn at either of the user's sides.

Figure 3:
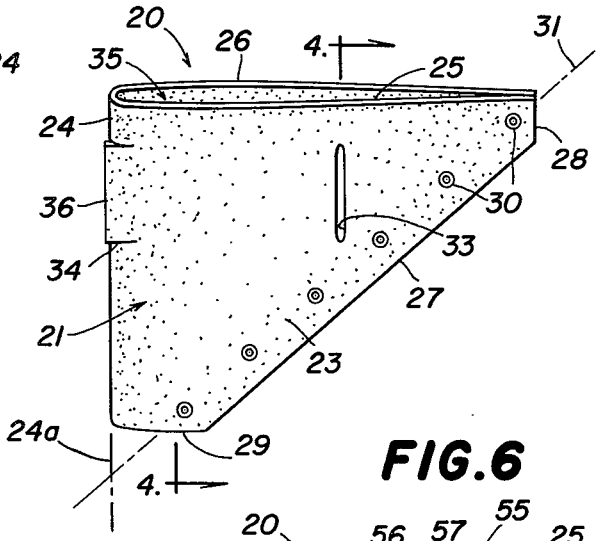
FIG. 3 is a rear perspective view of the holder illustrated in FIG. 1.
Figure 4:
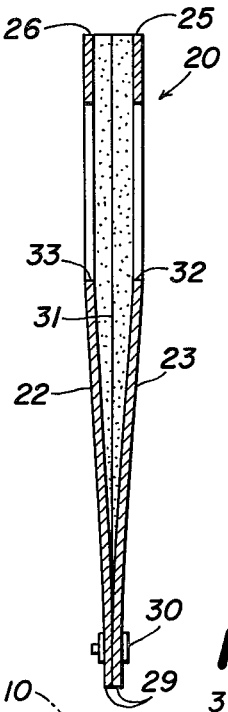
FIG. 4 is an enlarged view in vertical section taken along the line 4—4 in FIG. 3.
Figure 5:
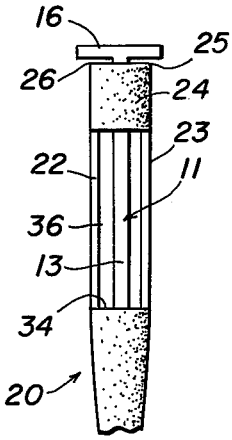
FIG. 5 is an enlarged fragmentary end elevational view of the holder of FIG. 3, as viewed from the left-hand end thereof, and with the associated carpenter's square inserted therein.

Each of the front and rear panels 22 and 23 is generally in the shape of a truncated right triangle, the panels 22 and 23 being respectively provided with top edges 25 and 26 which are disposed in use substantially parallel with each other and perpendicular to the fold line **24*a* of the fold portion 24 (see FIG. 3). Each of the panels 22 and 23 also includes an inclined side edge 27 disposed opposite the fold portion 24 and connected at the upper end thereof to the corresponding top edge 25 or 26 by a short upper edge portion 28 parallel to the fold line 24*a*, and connected at the lower end thereof to the fold portion 24 by a bottom edge 29 which is substantially parallel to the corresponding top edge 25 or 26**.

The side edges 27 of the front and rear panels 22 and 23 are secured together by suitable fastening means such as a plurality of spaced-apart rivets 30, to define a closure line 31. When the sheet 21 is thus closed, it defines a generally triangular pocket 35 which is open at the upper and lower ends thereof, and is dimensioned to receive the associated carpenter's square 10 therein. More particularly, the closure line 31 is inclined at substantially 45° angles with the fold line **24*a* and with the top edges 25 and 26 (see FIG. 3). Preferably, the vertical extent of the fold portion 24 is slightly less than the length of the edge 13 of the square 10 so that, when the square 10 is fully inserted into the holder 20, the flange 16 thereof rests on the top edges 25 and 26, with the opposite corner of the square 10 projecting through the open bottom end of the holder 20 (see FIG. 2), and with the edge 15 of the holder 10 lying substantially along the closure line 31 of the holder 20. It will be appreciated that this arrangement makes it virtually impossible for the square 10 to accidentally fall out of the holder 20 unless the holder 20** is completely inverted.

In order to facilitate mounting of the holder 20 on a user's belt, the front and rear panels 22 and 23 are respectively provided with vertical slits 32 and 33 therein, while the fold portion 24 is provided with a vertical slit 34 therein disposed in alignment with the slits 32 and 33. Preferably, the slit 34 is an I-shaped slit so that, when the sheet 21 is folded, short tabs 36 are formed on the front and rear sides of the slit 34.

Figure 2:
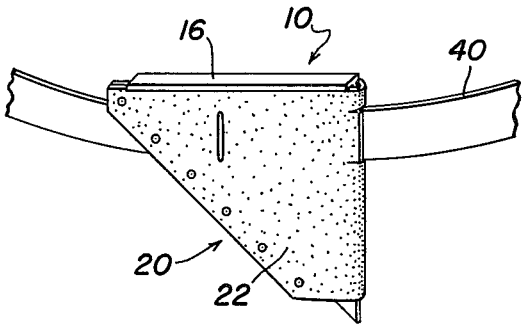
FIG. 2 is a reduced perspective view, similar to FIG. 1, showing the carpenter's square fully inserted in the holder and with the holder mounted on an associated belt.

It will be appreciated that, in use, an associated belt 40 of a user is inserted through the slit 33 of the rear panel 23 and the slit 34 of the fold portion 24 for mounting the holder 20 against the wearer's right side (see FIG. 2). It will be understood that, if desired, the holder 20 could also be worn on the carpenter's left side by inserting the belt 40 through the slits 32 and 34, in which case the front panel 22 would be disposed against the user's left side.

Figure 8:
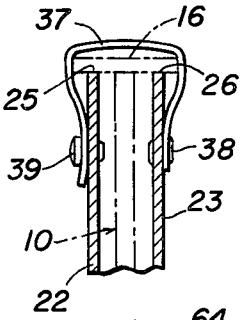
FIG. 8 is a further enlarged fragmentary view in vertical section taken along the line 8—8 in FIG. 7.
Figure 7:
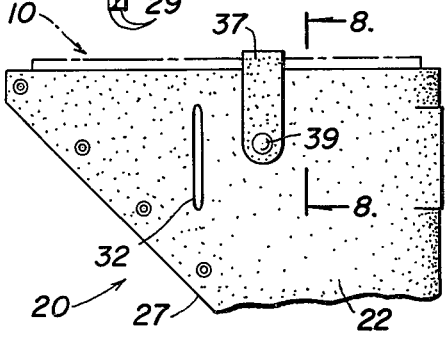
FIG. 7 is an enlarged fragmentary front elevational view of the holder of FIG. 1 with a retaining strap thereon.

Referring to FIGS. 7 and 8 of the drawings, the holder 20 may also be provided with a strap 37 having a length sufficient to permit it to extend over the flange 16 of an associated square 10 when it is mounted in the holder 20, with the ends of the strap 37 being respectively releasably securable to snaps 38 and 39 or the like fastened to the front and rear panels 22 and 23. This strap 37 securely fastens the square 10 in place, and is useful when the carpenter is not using the square 10 for an extended period of time.

Figure 6:
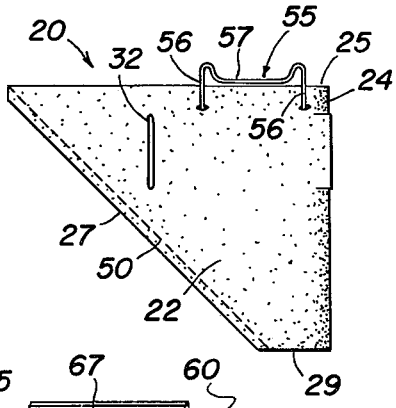
FIG. 6 is a front elevational view of a modified form of the holder of FIG. 1.

Referring to FIG. 6 of the drawings, there is illustrated an alternative form of the holder 20, which is identical to that shown in FIG. 1 in all respects except the manner of closure of the side edges 27 and the manner of mounting on the user's belt. In the embodiment of FIG. 6 the side edges 27 are stitched together along a seam 50, which defines the closure line 31. It will be appreciated that other types of closure means could be used along the side edges 27, depending upon the type of material utilized to form the holder 20. The holder 20 illustrated in FIG. 6 is also provided with a belt clip 55, either in addition to or in place of the slits 32–34. The clip 55 includes a pair of attachment arms 56 which are fixedly secured to one of the panels 22 or 23, and which are interconnected by a bight portion 57 which is bent to form a hook-like member which can be hung on the user's belt for supporting the holder therefrom. This arrangement facilitates removal of the holder 20 without the necessity of unbuckling and removal of the user's belt.

Figure 9:
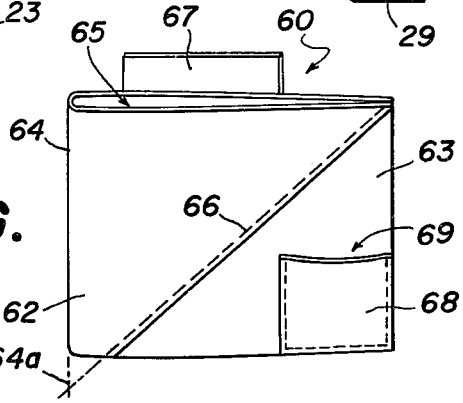
FIG. 9 is a reduced front perspective view of a modified form of the holder of FIG. 1.

Referring to FIG. 9 of the drawings, there is illustrated yet another alternative form of the holder of the present invention, generally designated by the numeral 60. The holder 60 preferably includes a one-piece sheet 61 of flexible material, which is folded to form a generally triangular front panel 62 and a generally rectangular rear panel 63 interconnected by a fold portion 64, with the top edges of the front and rear panels 62 and 63 being substantially coplanar. The front panel 62 is secured to the rear panel 63 as by stitching along an inclined closure line 66 which is disposed at a predetermined acute angle, preferably 45°, to the fold line **64*a* of the fold portion 64. When the front and rear panels 62 and 63 are thus secured together, they cooperate with the fold portion 64 to form a generally triangular pocket 65 which is open at the upper and lower ends thereof, and is dimensioned to receive the associated carpenter's square 10 therein, in the same manner as was described above in connection with the holder 20 of FIG. 1**.

Secured to the rear panel 63 adjacent to the upper edge thereof is an attachment flap 67 designed to be sewn or otherwise secured to an associated belt or apron of a user. The rear panel 63 extends beyond the closure line 66 and preferably has secured thereto adjacent to the lower corner thereof outside the perimeter of the pocket 25 an auxiliary sheet or panel 68, which is preferably secured as by stitching along three edges to define an open-top auxiliary pocket 69, dimensioned to receive an auxiliary tool such as a tape measure or the like.

While, in the preferred embodiments illustrated in the drawings, the holder 20 has been shown dimensioned to receive the associated square 10 substantially completely therein, with the flange 16 resting on the holder top edges 25 and 26, it will be appreciated that, if desired, the holder 20 could be made smaller so as to provide a wedge fit of the square 10 therein. In such an arrangement, the square 10 might project a predetermined distance above the top edges 25 and 26 of the holder 20 to facilitate grasping thereof by the user.

In a constructional model of the holder 20, the sheet 21 is formed of a heavy-duty leather, but it will be appreciated that other materials could be used. Thus, fabrics such as canvas or synthetic sheet materials could also be used, it being only necessary that the material be sturdy enough to withstand heavy use, and have a flexibility sufficient to permit formation into the desired shape, while at the same time having sufficient stiffness to support the flange 16 on the upper edges 25 and 26.

While there have been described what are at present considered to be the preferred embodiments of the invention, it will be understood that various modifications may be made therein, and it is intended to cover in the appended claims all such modifications as fall within the true spirit and scope of the invention.

What is claimed is:

1. A belt-mountable holder for a triangular carpenter's square having a laterally extending flange along one side edge thereof, said holder comprising a flexible sheet of unitary single-piece construction arranged in a single-folded configuration, said sheet including a front panel and a rear panel disposed in overlapping relationship with each other and a fold portion interconnecting said front and rear panels along a fold line, each of said front and rear panels having a straight top edge with said top edges being substantially parallel with each other and interconnected by said fold portion, means securing together said front and rear panels along a straight closure line disposed at a predetermined acute angle to said fold line for cooperation with said fold portion and with said front and rear panels to define a substantially triangular pocket dimensioned to accommodate therein an associated triangular carpenter's square so that the flange thereof is supported on said top edges, and means for attaching said holder to the belt of a user.

2. The holder of claim 1, wherein each of said front and rear panels has a straight bottom edge disposed substantially parallel to the top edge thereof, said bottom edges being interconnected by said fold portion and cooperating therewith to define a truncated open bottom of said pocket.

3. The holder of claim 1, wherein each of said front and rear panels is provided with spaced-apart apertures therethrough for receiving an associated belt of a user for mounting said holder on the belt.

4. The holder of claim 1, wherein said predetermined acute angle is forty-five degrees.

5. The holder of claim 1, wherein said top edges are disposed substantially perpendicular to said fold line.

6. A belt-mountable holder for a triangular carpenter's square comprising a flexible sheet of unitary single-piece construction arranged in a single-folded configuration, said sheet including a front panel and a rear panel larger than said front panel and disposed in overlapping relationship therewith and a fold portion interconnecting said front and rear panels along a fold line, each of said front and rear panels having a straight top edge with said top edges being substantially parallel with each other and interconnected by said fold portion, means securing together said front and rear panels along a straight closure line disposed at a predetermined acute angle to said fold line for cooperation with said fold portion and with said front and rear panels to define a substantially triangular pocket dimensioned to accommodate an associated triangular carpenter's square, auxiliary holder means on said rear panel outside the perimeter of said front panel, and means for attaching said holder to the belt of a user.

7. The holder of claim 6, wherein said rear panel is substantially rectangular in shape, said auxiliary holder means comprising an auxiliary panel secured along the sides and bottom thereof to the front surface of said rear panel thereby to define an open-top auxiliary pocket.

8. A belt-mounted holder for a triangular carpenter's square comprising a flexible sheet of unitary single-piece construction arranged in a single-folded configuration, said sheet including a front panel and a rear panel disposed in overlapping relationship with each other and a fold portion interconnecting said front and rear panels along a fold line, each of said front and rear panels having a straight top edge with said top edges being substantially parallel with each other and interconnected by said fold portion, and means securing together said front and rear panels along a straight closure line disposed at a predetermined acute angle to said fold line for cooperation with said fold portion and with said front and rear panels to define a substantially triangular pocket dimensioned to accommodate an associated triangular carpenter's square, each of said front and rear panels and said fold portion being provided with a spaced-apart aperture therethrough for receiving an associated belt of a user for mounting said holder on the belt, the associated belt being receivable through said apertures in said front panel and said fold portion for mounting said holder on one side of the user and being receivable through said apertures in said rear panel and said fold portion for mounting said holder on the other side of the user.

* * * * *